US005686685A

United States Patent [19]

McDonald et al.

[11] Patent Number: 5,686,685

[45] Date of Patent: Nov. 11, 1997

[54] SYSTEM FOR PNEUMATIC DELIVERY OF EMULSION EXPLOSIVES

[75] Inventors: Keith J. McDonald, Abbotsford, Canada; Kerry S. Atkinson, Lehi, Utah

[73] Assignee: Dyno Nobel Inc., Salt Lake City, Utah

[21] Appl. No.: 665,863

[22] Filed: Jun. 19, 1996

[51] Int. Cl.[6] ..... F42D 1/10

[52] U.S. Cl. ..... 86/20.15; 102/313

[58] Field of Search ..... 86/20.15; 102/312, 102/313, 315

[56] References Cited

U.S. PATENT DOCUMENTS

| | | | |
|---|---|---|---|
| 2,821,205 | 1/1958 | Chilton et al. | 137/13 |
| 3,414,004 | 12/1968 | Bankston | 137/237 |
| 3,886,972 | 6/1975 | Scott et al. | 137/602 |
| 4,259,977 | 4/1981 | Brockington | 137/13 |
| 4,273,147 | 6/1981 | Olney | 137/13 |
| 4,462,429 | 7/1984 | Coursen | 137/891 |
| 4,555,278 | 11/1985 | Cescon et al. | 149/21 |
| 4,615,752 | 10/1986 | Miller | 149/108.8 |
| 4,931,110 | 6/1990 | McKenzie et al. | 149/2 |
| 4,996,077 | 2/1991 | Halliday et al. | 102/313 |

*Primary Examiner*—Christine Skane
*Assistant Examiner*—John R. Hardee

[57] ABSTRACT

Apparatus for delivery under pressure of emulsion explosives to boreholes using an annular stream of water for lubrication. Maintaining the water pressure at least 10 psi greater than the emulsion pressure has been found to maintain the integrity of the lubricating annulus of water.

6 Claims, 1 Drawing Sheet

SYSTEM FOR PNEUMATIC DELIVERY OF EMULSION EXPLOSIVES

FIELD OF THE INVENTION

The present invention relates to a system and method for delivering emulsion explosives from a pressurized vessel into a borehole. More specifically, the system and method comprise pneumatically extruding an emulsion explosive from a pressurized vessel, through a delivery hose and into a borehole. The flow of the emulsion explosive through the delivery hose is lubricated by the injection of an annular stream of pressurized water between the outer surface of the emulsion and the inner surface of the delivery hose. The combination of pneumatic extrusion and water injection lubrication allows for a safe, simple system for the delivery of emulsion explosives into boreholes.

BACKGROUND OF THE INVENTION

The emulsion explosives of the present invention comprise water-in-oil emulsions that are well known in the art. See, for example, U.S. Pat. No. 4,931,110. These explosives contain a continuous organic liquid fuel phase throughout which is dispersed droplets of an aqueous or aqueous-miscible inorganic oxidizer salt solution phase. The term "water-in-oil" means any highly polar, hydrophilic liquid or melt as the "water" or equivalent and hydrophobic, nonpolar liquids are considered "oils." An emulsifier generally is used to form the emulsion.

Emulsion explosives normally are fluid even after storage at ambient temperatures and thus are pumpable from a container into packages or boreholes. One problem with the pumping or repumping of emulsion explosives, however, is the high level of pumping pressure required due to the relatively high viscosity of the emulsion explosive. Nevertheless, a viscous emulsion explosive is desirable in order to resist running into cracks and fissures in boreholes, erosional effects of dynamic water and gravitational flow when loaded into upwardly extending boreholes. Past efforts at pumping relatively viscous emulsion explosives have required expensive, heavy-duty pumps capable of producing high pressure heads. Such pumps and the resulting pressures or potential pressures create safety concerns in mining operations and also may exert destructive forces on the stability of the emulsion or its ingredients.

Since pumping emulsion explosives involves the input of dynamic or kinetic energy into the explosive, attendant safety concerns are present. In addition to the potentially high operating pressure required for the pump, a pump running against a dead head can add considerable energy to the medium being pumped, i.e., the emulsion explosive, and could result in an unwanted detonation. In addition, if the pump is run "dry" such that no emulsion explosive is being pumped, any residual product also may experience considerable energy input to the extent that it may overheat and self-detonate. Thus sophisticated pump monitoring and shutdown systems have been designed and implemented in various emulsion explosives pumping applications. These detection systems, however, are expensive to install and difficult to maintain in an operational mode. Thus a need exists for a system for delivering emulsion explosives into boreholes that does not involve the use of expensive, high pressure pumps. The present invention provides a system and method whereby emulsion explosives can be extruded pneumatically at a relatively low pressure from a pressurized vessel through an outlet and delivery hose. The addition of a water injection system provides an annular stream of water around the extruded emulsion explosive to lubricate its passage through the delivery hose. The advantages of this system and method include:

1. The cost of the system is a fraction of the cost of a progressive cavity pump system.

2. The operation of the system is simpler and the maintenance is less than that for a pump system. The present system requires no hydraulics, electrical current or dynamic or moving parts.

3. The system is inherently safer than a pump system since potentially high pressures and temperatures are avoided.

4. The system is considerably quieter to operate than a pump system, which result is desirable particularly in underground applications.

The use of a water injection system in the delivery of an emulsion explosive through a delivery hose is known in the art. See, for example, U.S. Pat. Nos. 4,273,147 and 4,615,752. This helps reduce the pumping pressure requirements of a pump system, provided the water annulus is maintained. The use of such system with a pneumatically delivered emulsion explosive, however, is not known in the art. The combination of a pneumatically operated pressurized vessel for extruding the emulsion explosive and a water injection system for lubricating the flow of the emulsion explosive through a delivery hose provides for the synergistic advantages of the present invention. Not only are the dynamic hazards of operating an expensive pumping system eliminated, but water injection lubrication allows for the emulsion explosive to be delivered at a relatively low extrusion pressure, and generally at a pressure that is readily available at most mining operations.

SUMMARY OF THE INVENTION

The present invention provides a system for the pneumatic extrusion of an emulsion explosive into a borehole. This system comprises a pressurized vessel for holding the emulsion explosive under pressure, a pressurized water source (preferably a vessel for holding water under pressure), an outlet from the emulsion vessel, a water injector connecting the outlet to a delivery hose and a conduit (such as a hydraulic hose) for providing the pressurized water to the water injector. As used herein, the term "emulsion explosive" also shall include unsensitized emulsion phase. As emulsion is extruded through the outlet and into the water injector, the pressurized water is injected as an annular stream around the emulsion explosive to lubricate its flow through the delivery hose. The method of the present invention comprises pneumatically extruding the emulsion explosive from a pressurized vessel through an outlet extending from the vessel, providing pressurized water as an annular stream around the emulsion explosive as it is extruded from the outlet and into a water injector, and delivering the emulsion explosive into a borehole through a delivery hose that is connected to the water injector, whereby the annular stream of water lubricates the flow of the emulsion explosive through the delivery hose. Thus the system and method of the present invention provide a safe, simple, relatively inexpensive way of delivering an emulsion explosive into a borehole, and the system and method are particularly adaptable to the loading of small diameter boreholes underground.

DETAILED DESCRIPTION OF THE INVENTION

Figure 1:
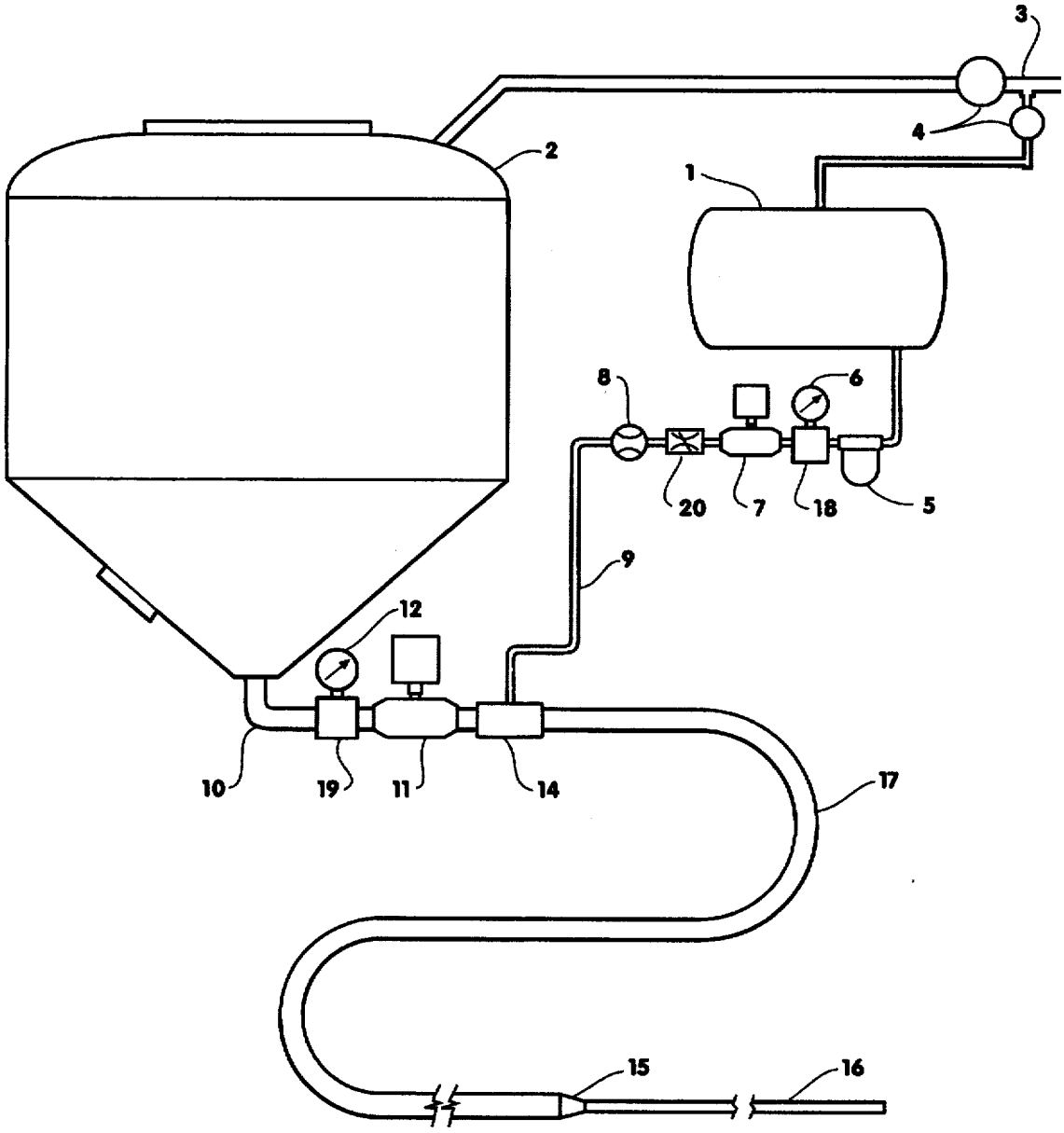
FIG. 1 is a simplified schematic view of the system.

The system includes a pressurized water source, which preferably is a pressure vessel 1, although the pressurized water could be supplied from an unpressurized tank and pump. The system further includes an emulsion pressure vessel 2. A source of pressurized or compressed air 3 (not shown) is delivered to the water vessel 1 and the emulsion vessel 2 through pressure regulators 4. Pressure release valves (not shown) for both the tank 1 and vessel 2 preferably are provided. The emulsion vessel 2 contains an emulsion explosive that is to be extruded from the vessel and into a borehole. The emulsion explosive is pneumatically extruded from the emulsion vessel by means of air or gas pressure. If pressurized air is not available at a mine site, then a canister of compressed air or nitrogen could be used, for example. When ball valve 11 is open, the emulsion flows through the outlet 10, transducer 19 and into the water injector 14. The pressure of the emulsion is monitored by pressure gauge 12. The water injector 14 is adapted to form a thin annular sleeve of the pressurized water around the rod of emulsion being extruded through the outlet 10. This thin annulus of water around the extruded emulsion explosive lubricates its flow through a first hose portion 17, a coupler 15 and a delivery hose 16.

The water is delivered to the water injector 14 pneumatically from the water vessel 1 through conduit 9. The water preferably passes through a water filter 5, transducer 18, an open ball valve 7 and a flow meter 8.

The pressure of the water delivered to the water injector 14 is equal to or higher than the pressure of the emulsion. Preferably, the water pressure is maintained at a level of at least 10 psi higher than the pressure of the emulsion. This pressure requirement has been found necessary to maintain the integrity of the lubricating annulus of water. The pressure differential between the emulsion and water pressures can be varied depending on the rheology of the emulsion. Water injection is an essential aspect of the invention, since it lubricates the flow of the emulsion through the delivery hose and keeps the extrusion pressure requirement at an acceptably low level. The water injection should occur close to the outlet of the emulsion vessel to keep the extrusion pressure as low as possible.

A further way of maintaining a low extrusion pressure is to keep the internal diameter of the outlet 10, water injector 14, and first hose portion 17, as large as possible, particularly if the delivery hose 16 must have a reduced diameter in order to be insertable into smaller diameter boreholes. In addition, the length of the reduced diameter delivery hose 16 should be minimized to the minimal length necessary for loading boreholes of given depth. The coupler 15 is a transition fitting preferably designed to reduce gradually the cross-sectional diameter of the extruded rod of emulsion and annular layer of water from the internal diameter of the first hose portion 17 to the reduced internal diameter of the delivery hose 16. Preferably, the female end of the coupler 15 connects to the larger diameter first hose portion 17 and the male end connects to the smaller diameter delivery hose 16, in order to keep the internal surfaces and size transitions as small as possible so that the integrity of the water annulus is maintained. All of these various configurations are intended to reduce frictional drag on the extruded emulsion and to maintain the integrity of the water annulus so that the extrusion pressure is kept at an acceptably low level.

The selection of the particular components of the system is well within the capabilities of one skilled in the art. The water vessel 1 and emulsion vessel 2 must be capable of being pressurized and preferably are made of stainless steel. For example, a small-diameter underground application might involve a water tank having a 10-gallon capacity and an emulsion vessel having a 1600-pound capacity. The water preferably is injected at a rate of about 5% or less by weight of the emulsion being extruded, and more preferably about 3% or less. The water can be replaced with an oxidizer salt solution or other aqueous solution as is known in the art. For example, a surfactant in the aqueous solution can add lubricity to the annulus and helps maintain the annulus during shut-down periods. As used herein, the term "water" shall include such aqueous solutions. The various valves, conduit, hoses, flow meters and pressure regulators can be standard, off-the-shelf items. The water injector can be of a design commonly used in the art. The internal surfaces of the coupler 15 and delivery hose 16 should be smooth in order to maintain the integrity of the annular water stream. The delivery hose 16, although flexible, must have a sufficient degree of rigidity to be insertable into boreholes.

If the mine has a source of air pressure of about 80 psi or more, then such source readily can be used to pressurize the water vessel and emulsion vessel. Otherwise, a source of compressed air must be provided. With an emulsion having a standard viscosity of about 14,000 centipoise, and a delivery hose having an internal diameter of about 0.75 inch, the pressure of the emulsion vessel would need to be about 80 psi or more, and correspondingly, the water pressure preferably would be about 90 psi or more. These parameters will produce flow rates of about 85 lbs. of emulsion per minute and about 2.5 lbs. of water per minute. Obviously, these parameters and equipment sizes can be adjusted singularly or in various combinations to produce a desired range of flow rates. The temperature of the water and emulsion can be ambient.

EXAMPLE 1

A test was conducted wherein the system had an emulsion vessel pressurized at 80 psi and a water vessel pressurized at 90 psi. The system was used to load an entire drift round of 55 holes, 12 feet long and 1.75 inches in diameter, with an emulsion explosive having a viscosity of about 14,000 centipoise. The outlet from the emulsion vessel, the water injector and the first hose portion all had an internal diameter of 1 inch. The first hose portion was flexible rubber having a length of 25 feet. The delivery hose was flexible rubber, had an internal diameter of 0.75 inch and a length of 15 feet. It took about 5 to 7 seconds to load each hole, a rate that is comparable to that obtainable with a progressive cavity pump system. After loading was complete, the product remaining in the hose was ejected by the pressurized water. The loading operation was simple, straight-forward and quiet in comparison to a pump system.

EXAMPLE 2

A test was conducted wherein the system had, an emulsion vessel pressurized at 35 psi, and a water vessel pressurized at 55 psi. The emulsion explosive had a viscosity of about 14,000 centipoise. The outlet from the emulsion vessel, the water injector and the first hose portion all had an internal diameter of 1 inch. The first hose portion was flexible rubber having a length of 30 feet. The delivery hose was flexible rubber, had an internal diameter of 0.75 inch and a length of 17 feet. The emulsion delivery rate was 110 pounds/min., which is comparable to that obtainable with a progressive cavity pump system. During the loading procedure, interruptions or shut down times of 15–20 minutes periodically occurred without disruption of the water annulus, which continued to provide lubrication upon resumption of the extrusion process.

As indicated previously, the term "emulsion explosive" also shall include unsensitized emulsion phase which can be sensitized after the extrusion from the emulsion vessel by the addition of chemical gassing ingredients or solid density control, as is known in the art.

While the present invention has been described with reference to certain illustrative examples and preferred embodiments, various modifications will be apparent to those skilled in the art and any such modifications are intended to be within the scope of the invention as set forth in the appended claims.

What is claimed is:

1. A system for the pneumatic injection of an emulsion explosive into a borehole comprising:

(a) a pressurized emulsion vessel for holding an emulsion explosive under pressure and having an outlet through which the emulsion explosive can be pneumatically discharged, (b) a water injector connected to the outlet for forming an annular stream of pressurized water around the emulsion explosive, (c) a pressurized water source for providing pressurized water to the water injector at a pressure at least 10 psi greater than the pressure of the emulsion explosive, and (d) a delivery hose extending from the water injector for delivering the emulsion explosive from the emulsion vessel into a borehole, whereby the annular stream of pressurized water lubricates the flow of the emulsion explosive through the delivery hose.

2. A system according to claim 1 wherein the pressurized water source comprises a pressurizable water vessel and a conduit leading from the water vessel to the water injector.

3. A system according to claim 1 wherein the internal diameter of the delivery hose is less than the internal diameters of the outlet and water injector and the delivery hose is connected to the water injector through a coupler that does not disrupt the annular stream of water around the emulsion explosive.

4. A system according to claim 3 wherein a first hose portion is interposed between the water injector and the coupler.

5. A method for the delivery of an emulsion explosive into a borehole comprising:

(a) pneumatically extruding the emulsion explosive from a pressurized vessel through an outlet extending from the vessel, (b) providing pressurized water at a pressure at least 10 psi greater than the pressure of the emulsion explosive and as an annular stream around the emulsion explosive as it is extruded from the outlet, and (c) delivering the emulsion explosive from the outlet and into a borehole through a delivery hose, whereby the annular stream of water lubricates the flow of the emulsion explosive through the delivery hose.

6. A method according to claim 5 wherein the diameter of the delivery hose is less than the diameter of the outlet.

* * * * *